US005348194A

United States Patent [19]

Mascitelli et al.

[11] Patent Number: 5,348,194

[45] Date of Patent: Sep. 20, 1994

[54] ATOMIZER BOTTLE WITH PUMP OPERABLE BY SQUEEZING

[75] Inventors: Francesco Mascitelli, Pescara; Enrico Bonelli, Chieti, both of Italy

[73] Assignee: SAR S.p.A., Italy

[21] Appl. No.: 20,146

[22] Filed: Feb. 19, 1993

[30] Foreign Application Priority Data

Feb. 28, 1992 [IT] Italy ..... MI92 A 000452

[51] Int. Cl.[5] ..... B65D 37/00

[52] U.S. Cl. ..... 222/209; 222/211; 222/213; 222/214; 222/321; 222/341; 222/385

[58] Field of Search ..... 222/206, 209, 211, 212, 222/213, 214, 215, 321, 340, 341, 385

[56] References Cited

U.S. PATENT DOCUMENTS

| | | | |
|---|---|---|---|
| 523,254 | 7/1894 | Winkley | 222/213 |
| 2,861,839 | 11/1958 | Mellon | 222/385 X |
| 3,474,936 | 10/1969 | McDonnell | 222/212 X |
| 4,228,931 | 10/1980 | Ruscitti et al. | 222/321 |
| 4,434,916 | 3/1984 | Ruscitti et al. | 222/321 |
| 4,437,588 | 3/1984 | Shay | 222/321 |
| 4,603,794 | 8/1986 | De Ford et al. | 222/207 |
| 5,127,553 | 7/1992 | Weinstein | 222/211 X |
| 5,137,178 | 8/1992 | Stokes et al. | 222/214 X |

FOREIGN PATENT DOCUMENTS

| | | | |
|---|---|---|---|
| 0253495 | 1/1988 | European Pat. Off. . | |
| 2231571 | 1/1975 | France | 222/211 |
| 003357 | 12/1991 | Italy . | |
| 2184493 | 6/1987 | United Kingdom . | |
| 9008073 | 7/1990 | World Int. Prop. O. . | |
| 9101255 | 2/1991 | World Int. Prop. O. . | |

*Primary Examiner*—Andres Kashnikow
*Assistant Examiner*—Joseph A. Kaufman
*Attorney, Agent, or Firm*—Steinberg, Raskin & Davidson

[57] ABSTRACT

The atomizer bottle (10; 110), operable by manual squeezing, comprises in addition to the actual bottle (12, 112) containing the liquid to be atomized an atomizer capsule (22; 122) which closes the mouth (20: 120) of the bottle (12; 112). In the capsule (22; 122) there is inserted an atomization insert (26; 126) comprising a nozzle (27; 127) from which the atomized liquid emerges. The atomizer bottle (10; 110) also comprises a conventional pump (32; 132) with the relative dip tube (60; 160). The pump (32; 132) is enclosed within the bottle (12; 112) and is operable by axially pressing a hollow shaft (30; 130) projecting from it. The hollow shaft (30; 130) of the pump is rigid with the capsule (22; 122), and the interior of the shaft (30; 130) communicates with the nozzle (27; 127). Operating the pump by defarming the frame (32: 132) as a consequence of squeezing the bottle (12; 112), and maintaining the free end (62; 162) of the dip tube (60; 160) adjacent to the base (58; 158) of the bottle (12; 112) under all conditions are provided.

12 Claims, 4 Drawing Sheets

ATOMIZER BOTTLE WITH PUMP OPERABLE BY SQUEEZING

BACKGROUND OF THE INVENTION

This invention relates to atomizer bottles operable by squeezing the bottle. Such bottles are generally known as squeeze bottles. In addition to the actual bottle containing the liquid substance to be atomized, these known atomizer bottles comprise an atomizer capsule which closes the bottle mouth. A conventional atomization insert comprising a nozzle from which the atomized liquid emerges is inserted into the center of the atomizer capsule, the nozzle being connected to a dip tube, one end of which is connected to the capsule whereas its other end opens adjacent to the base of the bottle. For operational reasons the bottle is only about half filled, the remainder being occupied by air.

The bottle is of elastically deformable plastics material, so that the bottle can be easily deformed by squeezing it with one hand. This causes a certain quantity of atomized liquid to emerge from the nozzle of the atomizer capsule. In certain known atomizer bottles, the deformability of the bottle is limited to at least one predetermined region, so that if the other regions of the bottle are pressed there is no discharge of atomized liquid. Generally the bottle comprises two deformable regions arranged opposite each other to facilitate its squeezing by the hand gripping the bottle. The bottle is normally formed by blow-moulding. A closure cap is usually also provided to be screwed onto the neck of the bottle.

The atomizer bottles of the aforesaid type have however various drawbacks. Firstly, the quantity of substance which is atomized each time the bottle is squeezed reduces, for example squeezing force, as the level of liquid substance contained in the bottle reduces. In addition the atomization achieved is rather poor. In this respect the liquid particles of the spray obtained on squeezing the bottle vary considerably in size, with some being in the form of actual droplets.

Finally as the quantity of liquid substance contained in the bottle reduces, the force which has to be exerted on the bottle increases.

SUMMARY OF THE INVENTION

The object of the present invention is to obviate the drawbacks of atomizer bottles of the aforedescribed type.

This object is achieved according to the present invention by an atomizer bottle which, in addition to the actual bottle containing the liquid to be atomized and being elastically deformable by squeezing with one hand, comprises an atomizer capsule which closes the bottle mouth, in the capsule there being inserted an atomization insert comprising a nozzle from which the atomized liquid emerges, and is characterized by further comprising: a conventional pump with the relative dip tube, the pump being of the type operable by axially pressing a hollow shaft projecting from it, said pump being enclosed within the bottle, the hollow shaft of the pump being rigid with said capsule, and the interior of the shaft communicating with the exit nozzle for the atomized liquid; means for operating the pump as a consequence of squeezing the bottle: and means for maintaining the free end of the dip tube adjacent to the base of the bottle under all conditions. Conveniently, the means for operating the pump as a consequence of squeezing the bottle consist of an elastically deformable plastics frame of overall rhombic form positioned in the bottle such that an axis of the thombus coincides with the pump axis, the first of the two angles of the thombus which lie on said axis being rigid with the pump body and the second being in contact with the substantially rigid base of the bottle, the other two angles of the thombus being, in contact with respective opposing points on the side wall of the bottle, at least one of said two opposing points forming part of a region of the bottle side wall which is deformable by squeezing.

An extremely simple manner of achieving said means for maintaining the free end of the dip tube always adjacent to the base of the bottle is to make this tube, which is elastically flexible, of such a length that even when the pump body is in its position closest to the atomizer capsule, the edge of the tube is still adjacent to the base of the bottle.

The pump can be of the most traditional type, comprising two metal springs for returning it to its rest state, and a non-return valve of metal ball type at that end of the pump to which the dip tube is fixed. Such a pump is described for example in U.S. application No. 4,228,931 and in U.S. application No. 4,434,916.

If an "ecological" bottle is required, in the sense of a bottle of which all the constituent material call be easily salvaged when empty, a pump call be used of the type described in Italian patent application No. M191A 003357 of the present applicant.

This pump has no metal parts and in fact is formed completely of plastics material of one and the same type. It is therefore sufficient to make all the other constituent parts of the atomizer bottle of the same type of plastics material as used for the pump, for the bottle to be completely and conveniently salvageable once the last dose of atomized liquid has been dispensed.

BRIEF DESCRIPTION OF THE DRAWINGS

The invention will be more apparent from the description of two embodiments thereof given hereinafter by way of example only. In this description reference is made to the accompanying drawings, in which.

DETAILED DESCRIPTION OF THE PREFERRED EMBODIMENTS

Figure 1:
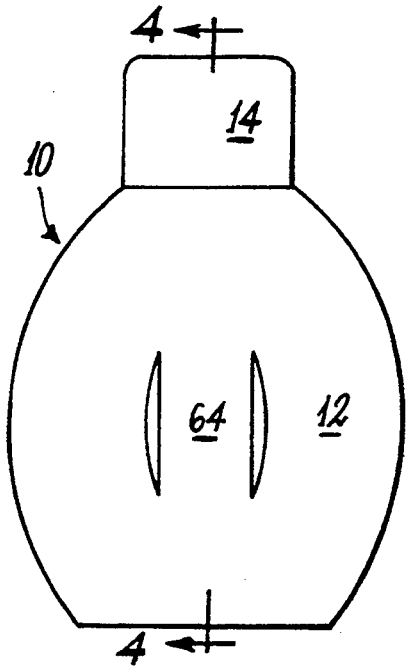
FIG. 1 is a side view of a first embodiment of the invention.
Figure 2:
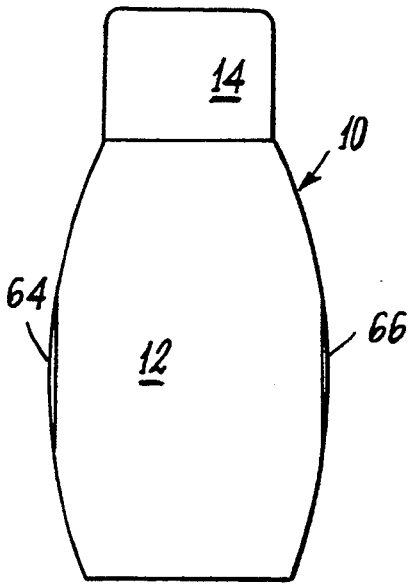
FIG. 2 is a view thereof in a direction perpendicular to that of FIG. 1.
Figure 3:
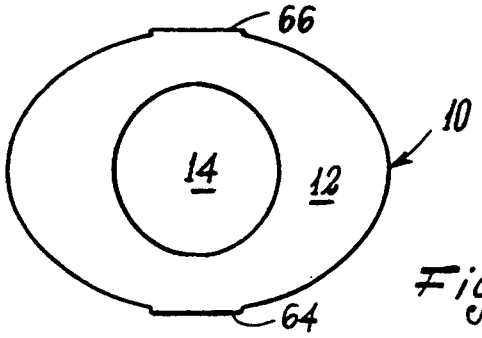
FIG. 3 is a top plan view thereof.

From FIGS. 1 to 4 it can be seen that the atomizer bottle 10 comprises an actual bottle 12 and a cylindrical atomizer capsule 22 which closes the circular mouth 20 of the bottle 12. The capsule 22 is protected by a cap 14 (visible in FIGS. 1–3) comprising an internal thread which enables it to be screwed onto the neck 16 (FIG. 4) of the bottle 12 because of the presence of a corresponding external thread 18 on this neck. The capsule 22 comprises all upper transverse wall 24 the outer surface of which is provided with a coaxial cavity into which there is inserted a conventional atomization insert 26 the nozzle 27 of which communicates with the interior of a hollow cylindrical projection 28 extending downwards from the wall 24 coaxially to the insert 26. In a suitable seat 32 provided in the lower end of the cylindrical projection 28 there is inserted the upper end of a hollow shaft 30 of a conventional pump 32, of the type widely used for dispensing liquid or creamy substances contained in bottles and operable by coaxially pressing the hollow shaft 30 projecting from the body 34 of the pump 32. In normal known applications the shaft of such a pump carries on its top end a dispensing knob provided with an atomization insert, the nozzle of which communicates with the interior of the shaft.

In the present example (see FIG. 4) the shaft 30 of the pump 32 is press-fitted into the seat 32 of the cylindrical projection 28 of the atomization capsule 22, so that the shaft 30 remains fixed relative to the bottle 12.

Figure 4:
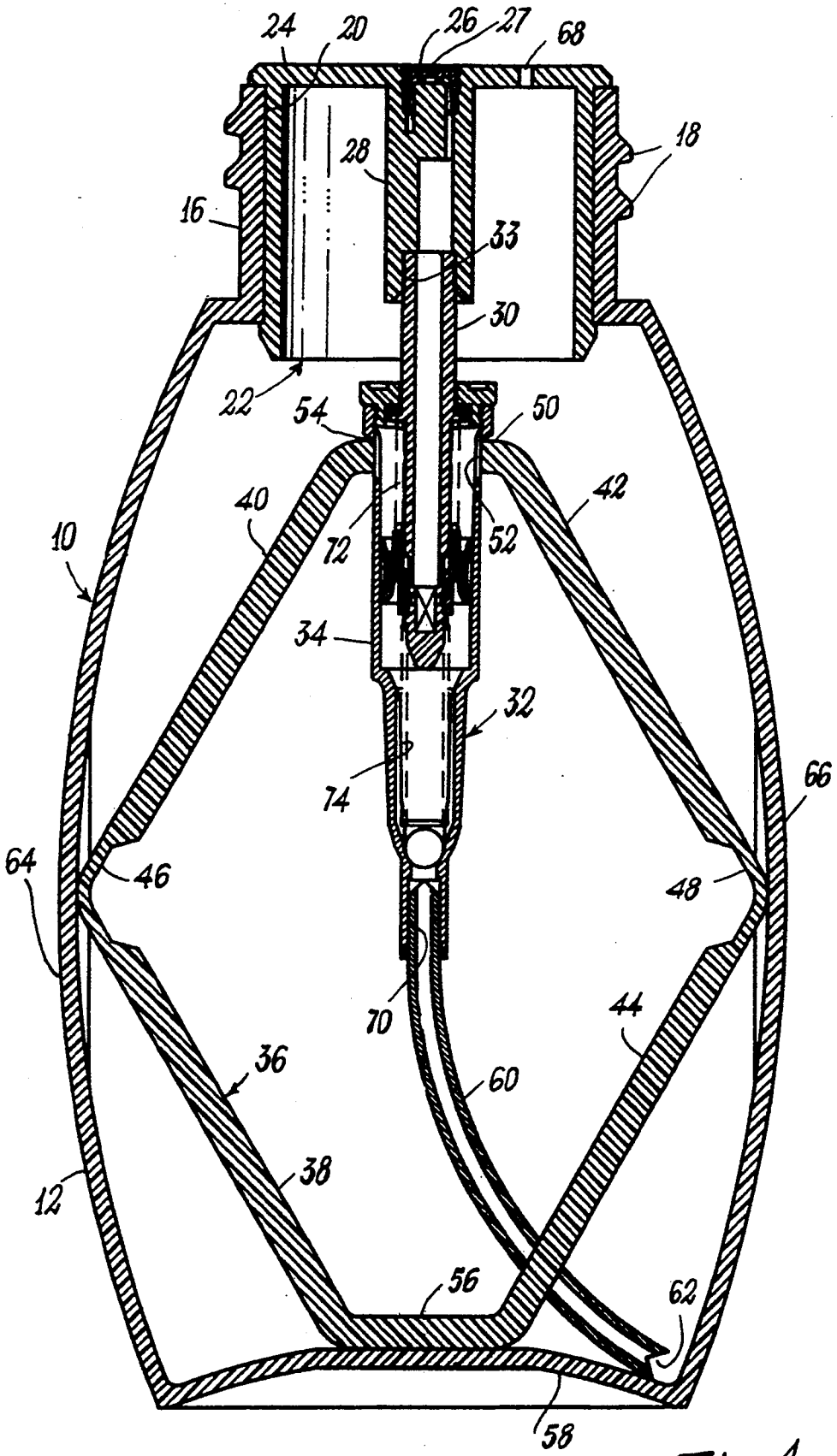
FIG. 4 is an enlarged vertical axial section on the line 4—4 of FIGS. 1 and 3 showing the bottle without the closure cap.

The hollow body 34 of the pump 32 is fixed to a frame 36 of approximately trapezium form, constructed of elastically deformable plastics material. This rhombic frame 36 behaves largely as an articulated quadrilateral, comprising four arms 38, 40, 42, 44. The arm 38 is connected to the arm 40 by a connection strip 46 of lesser thickness than the arms and integral with them. Likewise the arms 42 and 44 are connected together by a connection strip 48. The connectors 46 and 48 in practice form a simple hinge. The upper end of the arms 40 and 42 is integral with an annular connection element 50 comprising a hole 52 for forcedly receiving the intermediate part of the body 34 of the pump 32. This latter is hence forced into the hole 52 until the element 50 rests against the shoulder 53 provided on the body 34 of the pump 32. FIG. 4 shows the atomizer bottle 10 and pump 32 in the rest condition.

In this figure it can be seen that the lower arms 38 and 44 of the frame 36 are connected together at their lower end by a horizontal piece 56 which rests on the substantially rigid base 58 of the bottle 12.

In the lower end 70 of the pump 32 there is inserted a dip tube 60, the lower end 62 of which opens adjacent to the inner wall of the substantially rigid base 58 of the bottle 12.

The side wall of the bottle 12 comprises two opposing regions 64, 66 which are elastically deformable inboards by pressing with the fingers of the hand which grips the atomizer bottle 10. As is apparent, by simultaneously pressing against the two deformable regions 64, 66, the trapezium frame 36 is squeezed in a direction perpendicular to the axis of the pump 32, so that the two connection strips 46 and 48 approach each other. Consequently the element 50 of the frame 36 is urged upwards dragging with it the body 34 of the pump 32. As the shaft 30 of the pump 32 remains fixed relative to the bottle 12, the pump undergoes operation and if previously primed causes a predetermined quantity of the liquid substance contained in the bottle 12 to emerge from the nozzle 27 of the atomization insert 26 in a conveniently atomized form. When pressure on the deformable regions 64 and 66 ceases, the situation shown in FIG. 4 (rest condition) is automatically restored by virtue of the helical springs 72 and 74.

It should be noted that as a result: of the pressure exerted by the fingers on the regions 64 and 66 of the bottle 12, not only does the pump body 34 move upwards, but the dip tube 60 is also dragged upwards. This latter, of elastically deformable plastics material, must therefore be of such a length that even when the body 34 of the pump 32 is at the highest point of its travel, the lower end 62 of the dip tube 60 is still adjacent to the base 58 of the bottle 12. To achieve this it is merely necessary to suitably increase the length of the tube 60 beyond that which would be sufficient in the rest state. In this latter state the tube 60 is in the situation shown in FIG. 4, whereas when the body 34 of the pump 32 is in its condition of maximum upward travel, the lower end of the dip tube 60 is in a position more towards the center of the base 58 of the bottle 12, but still contact with the base 58. For completeness, it should be noted that in order to replace witch an equal volume of air the liquid substance withdrawn from the bottle 12 each time the pump is operated, the capsule 24 is provided with a hole 68 so that a vacuum is not created within the bottle 12.

In the particular example of the atomizer bottle 10, the actual bottle 12 is conveniently formed by blow moulding.

Figure 5:
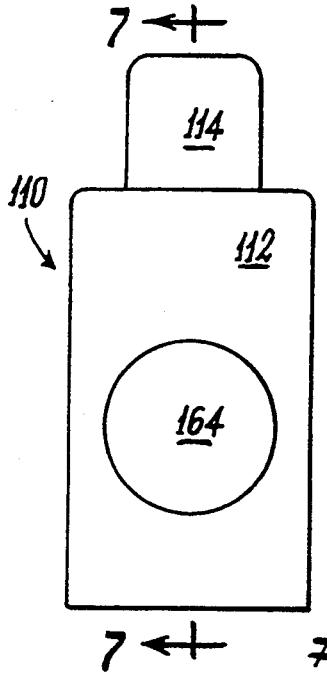
FIG. 5 is a side view of a second embodiment of the invention.
Figure 6:
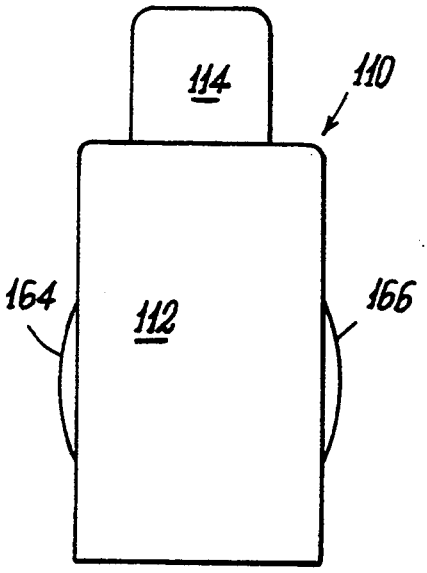
FIG. 6 is a view thereof in a direction perpendicular to that of FIG. 5.
Figure 7:
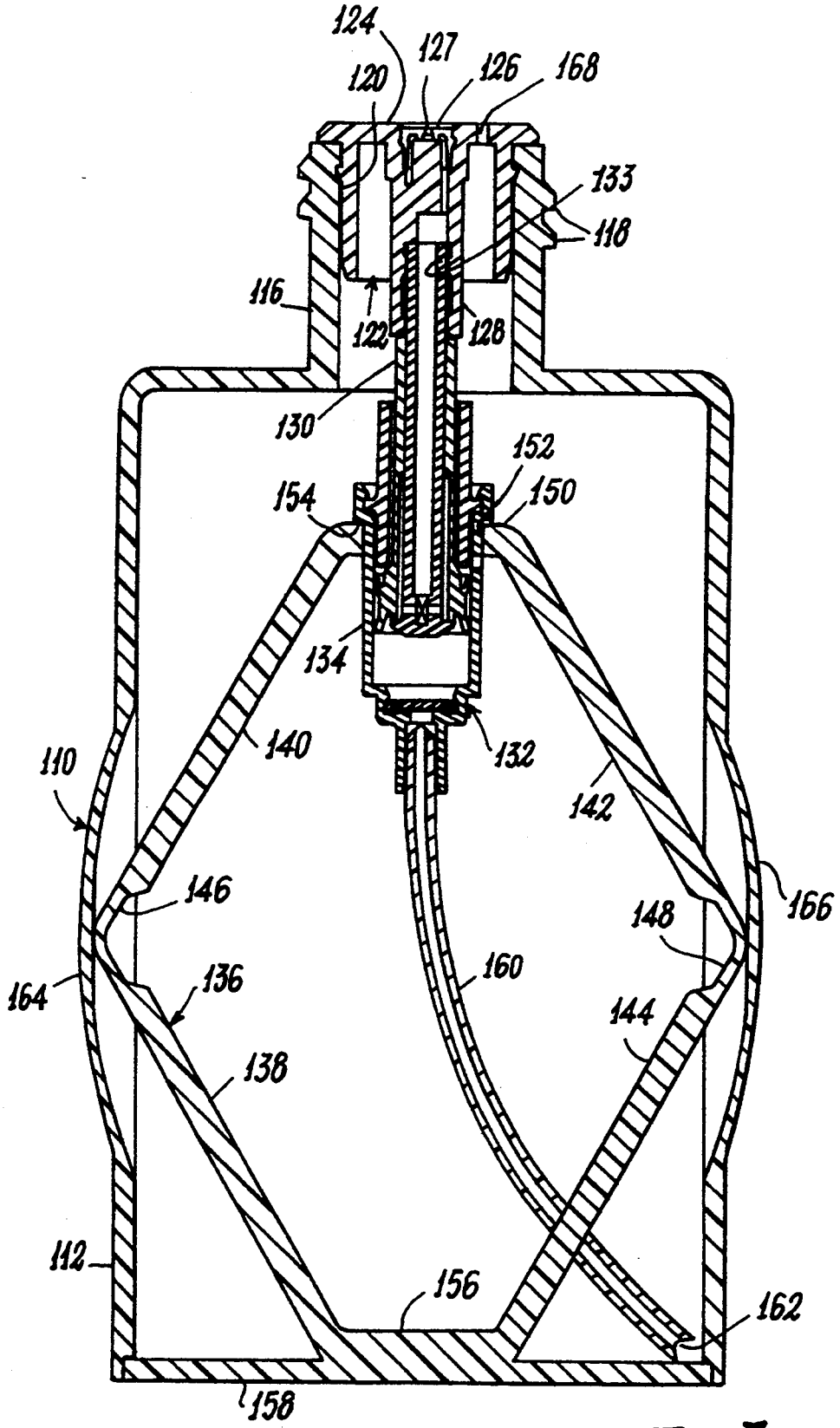
FIG. 7 is an enlarged vertical axial section on the line 7—7 of FIG. 5, showing the bottle without the closure cap.

FIGS. 5–7 show a modification of the atomizer bottle, in which the actual bottle 112 is formed by injection moulding. In these figures parts equal or similar to those of FIGS. 1–4 are indicated by the same reference numerals plus 100.

The atomizer bottle 110, of overall cylindrical form, uses a pump 132 totally of plastics construction, such as that described in the stated Italian patent application M191A003357. The pump 132 is preferably constructed of polyethylene, a plastics material available as low density polyethylene (LDPE), very low density polyethylene (LLDPE) and high density polyethylene (HDPE). Consequently if the bottle 112, the elastically deformable frame 136 and the capsule 112 are also constructed of polyethylene (or suitable density), an atomizer bottle 110 is obtained which once empty can be totally and conveniently salvaged, and which for this reason could be defined as ecological.

Specifically, the bottle 112, the capsule 122 with its insert 126 and the frame 136 are of low density polyethylene (LDPE). From tests carried out, it has been shown that the atomizer bottles of the present invention do not have any of the drawbacks of known pumpless atomizer bottles.

In this respect, besides dispensing at each operation (squeezing of the bottle) a predetermined constant quantity of atomized liquid substance, the atomizer bottle according to the invention achieves excellent atomization because of the presence of the pump. In addition, the squeezing force required to obtain discharge of the predetermined quantity of atomized liquid substance is always the same, until it has been totally consumed.

We claim:

1. An atomizer bottle operable by manual squeezing, said atomizer bottle comprising:

an elastically deformable bottle containing liquid to be atomized, said bottle having a hollow body, a mouth, a base, and side walls;

an atomizer capsule closing said mouth of said bottle;

an atomization insert located within said capsule and comprising a nozzle from which the atomized liquid emerges;

a pump having a dip tube and a hollow shaft, said pump being of the type operable by axially pressing said hollow shaft of said pump, said pump being enclosed within said bottle, said hollow shaft of said pump being rigid with said capsule and having an interior, said interior of said shaft communicating with said nozzle of said insert;

means for operating said pump by squeezing said bottle; and means for maintaining a free end of said dip tube adjacent to said base of said bottle.

2. The atomizer bottle of claim 1, wherein said means for operating said pump comprise elastically deformable plastic frames of overall rhombic shape positioned within said bottle such that an axis of the same coincides with an axis of said pump, said plastic frame forming four angles, the first angle lying on an axis which is rigid with said hollow body of said pump and the second angle being in contact with said base of said bottle, the other two angles being in contact with respective opposing points on said side walls of said bottle, at least one of said two opposing points forming part of a region of said side walls which is deformable by squeezing.

3. The atomizer bottle of claim 1, wherein said means for maintaining said free end of said dip tube adjacent to said base of said bottle comprise making said dip tube of such a length that said free end of said tube remains adjacent to said base of said bottle under all conditions.

4. The atomizer bottle of claim 1, wherein said pump comprises totally of plastic material of one and the same type, the other parts of said atomizer bottle also comprising of this type of plastic material.

5. A manually squeezeable atomizer bottle comprising:

an elastically deformable bottle containing liquid to be atomized, said bottle having a hollow body, a mouth, a base and side walls;

an atomizer capsule closing said mouth of said bottle;

an atomization insert located within said capsule, said atomization insert comprising a nozzle through which the atomized liquid emerges;

a pump having a hollow shaft and a dip tube, said pump being enclosed within said bottle, said hollow shaft of said pump being rigid with said capsule and having an interior, said interior of said hollow shaft communicating with said nozzle of said atomization insert, said dip tube having a free end adjacent to said base of said bottle; and an elastically deformable frame structure for operating said pump by squeezing said bottle, said frame structure being enclosed within said bottle.

6. The atomizer bottle of claim 5, wherein said dip tube of said pump is of a length such that said free end of said dip tube remains in contact with said base of said bottle under all conditions.

7. The atomizer bottle of claim 5, wherein said frame structure has a rhombus shape positioned within said bottle such that an axis of the same coincides with said axis of said pump, the thombus having four angles, the first angle lying on an axis being rigid with said hollow body of said pump and the second angle being in contact with said base of said bottle, the other two opposing angles of the rhombus being in contact with respective opposing points on said side walls of said hollow body of said bottle, at least one of said two opposing points forming part of a region of said side walls of said bottle which is deformable by squeezing.

8. The atomizer bottle of claim 7, wherein said frame structure comprises four arms, said arms are connected to one another by connection strips, said connection strips being hinges, an upper end of two of said arms being integral with an annular connection element, said element comprising a hole for forcedly receiving an intermediate part of said pump.

9. The atomizer bottle of claim 5, wherein said pump comprises two metal springs and a non-return valve of the metal ball type attached at an end of said pump to which said dip tube is affixed.

10. The atomizer bottle of claim 5, wherein said bottle has a neck with external threads and said capsule is protected by a cap, said cap having internal threads which enable said cap to be screwed onto said external threads of said neck of said bottle, thereby allowing said capsule to close said mouth of said bottle.

11. The atomizer bottle of claim 5, wherein said pump is preferably constructed of polyethylene in the form of low density polyethylene (LDPE), linear low density polyethylene (LLDPE) or high density polyethylene.

12. The atomizer bottle of claim 5, wherein said bottle, said capsule with insert and said frame structure are constructed of low density polyethylene (LDPE).

* * * * *